US007356882B1

(12) United States Patent
Guadagno, IV et al.

(10) Patent No.: US 7,356,882 B1
(45) Date of Patent: Apr. 15, 2008

(54) MAGNETIC FLOWER ATTACHMENT DEVICE

(76) Inventors: James V. Guadagno, IV, 11020 Cleveland Rd., Mokena, IL (US) 60448; Joni P. Guadagno, 11020 Cleveland Rd., Mokena, IL (US) 60448

( * ) Notice: Subject to any disclaimer, the term of this patent is extended or adjusted under 35 U.S.C. 154(b) by 0 days.

(21) Appl. No.: 11/283,657

(22) Filed: Nov. 22, 2005

(51) Int. Cl.
*A45F 5/08* (2006.01)

(52) U.S. Cl. ..... 24/5; 24/303

(58) Field of Classification Search ..... 24/303, 24/5, 6; 248/683, 206.5, 309.4; 63/29.2, 63/900; 224/183; 335/285, 286, 302
See application file for complete search history.

(56) References Cited

U.S. PATENT DOCUMENTS 1,932,143 A 10/1933 Piercy
2,379,596 A * 7/1945 Seamans ..... 294/65.5
2,592,395 A 4/1952 Cummings
3,068,573 A * 12/1962 Sidwell ..... 33/286
3,416,195 A 12/1968 Borthwick
3,512,741 A * 5/1970 Goldstein ..... 248/206.5
D273,206 S 3/1984 Sahler
5,682,648 A 11/1997 Miller
5,732,451 A 3/1998 Mars

* cited by examiner

*Primary Examiner*—James R Brittain
(74) *Attorney, Agent, or Firm*—Crossley Patent Law; Mark A. Crossley

(57) ABSTRACT

A device for holding flowers and ornaments to clothing, comprising a magnetic base positionable inside the clothing, a u-shaped parent holder with spike positionable outside the clothing and attracted to the magnetic base, an insert holder with spike positionable outside the clothing and within the parent holder, such that a smaller ornament is held within the insert holder. An orifice in the center of the outside of the insert holder transverse removably receives the spike of the parent holder. The holders are selectively used in combination or separately to secure large and small ornaments to clothing.

13 Claims, 5 Drawing Sheets

MAGNETIC FLOWER ATTACHMENT DEVICE

BACKGROUND OF THE INVENTION

Attachment of flowers such as corsages and boutonnieres and other ornaments to clothing is a common practice for many people, whether for formal occasions or simply for adornment. The use of pins is also common, but undesirable for a number of reasons. Typical reasons include difficulty in ornament attachment and the undesirability of piercing of clothing with the pin. A magnetically held ornament, with magnet either on the inside or outside of the clothing and accompanying holder for an ornament is a more desirable design. Problems also exist with such holders wherein various sizes and types or ornaments are difficult to accommodate. The present invention offers unique solutions to these problems.

FIELD OF THE INVENTION

The invention relates to personal flowers and ornaments and more especially to a magnetic flower and ornament attachment device for securing the same to clothing.

SUMMARY OF THE INVENTION

The general purpose of the magnetic flower attachment device, described subsequently in greater detail, is to provide a magnetic flower attachment device which has many novel features that result in an improved magnetic flower attachment device which is not anticipated, rendered obvious, suggested, or even implied by prior art, either alone or in combination thereof.

To accomplish this, the invention comprises a device for holding flowers and other like ornaments to clothing. The invention comprises a magnetic base positionable inside the clothing. The base may be positioned as desired. The u-shaped parent holder preferably containing a spike is positionable outside the clothing. The parent holder is attracted to the magnetic base. The parent holder thereby removably secures the ornament or flower or the like to the clothing without damage to cloth. An insert holder features an additional advantage of the invention. All ornaments are not sized or shaped identically, including flowers. The insert holder offers the same advantages of the parent holder with an exception. The insert holder can accommodate smaller ornaments. The insert holder, therefore, is used in the same fashion as the parent holder, as needed, or even in combination with the parent holder. Neither spike within the parent holder or the insert holder is of sufficient length to pierce the outside of clothing. The insert holder is of a like shape to the parent holder and is smaller. The insert holder thereby removably fits within the parent holder. A further unique feature of the invention is that the legs of the insert holder are sufficiently shorter than the legs of the parent holder, such that an ornament may fit within each holder and each holder still be attracted to and held to the magnetic base of the invention. As further explanation, when both the parent holder and the insert holder are utilized in conjunction, there is sufficient space between the transverse of the insert holder and the parent holder to allow additional ornament containment between the insert holder and the parent holder. Due to this feature, various ornaments and flower sizes can be used simultaneously. Each of the insert holder and the parent holder u-shape is comprised of a transverse with a preferably rounded right angle bend attaching two spaced apart parallel legs. One end of each leg further comprises an engagement face. The flat engagement faces are attracted to the magnetic base. The insert holder further comprises an orifice in the center of the outside of the insert holder transverse. The orifice is for removable receipt of the holder spike of the parent holder. The holders are selectively used in combination or separately to secure large and small ornaments to clothing. The magnetic and metallic properties of the base and the holders may be reversed. The invention features further versatility in use in that one or more of the inventions can be used at a given time, in various combinations. As example, the invention may be used with only the parent holder and magnetic base to hold an ornament, or two or more of the inventions may be used to more securely hold a larger ornament. Additionally, the insert holder may be used alone with the metallic base, or even a plurality of insert holders and metallic bases used. Further, the parent holder and insert holder may be used together either singularly, or in a plurality of applications.

Thus has been broadly outlined the more important features of the magnetic flower attachment device so that the detailed description thereof that follows may be better understood and in order that the present contribution to the art may be better appreciated.

Numerous objects, features and advantages of the magnetic flower attachment device will be readily apparent to those of ordinary skill in the art upon reading the following detailed description of presently preferred, but nonetheless illustrative, examples of the magnetic flower attachment device when taken in conjunction with the accompanying drawings. In this respect, before explaining the current examples of the magnetic flower attachment device in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the magnetic flower attachment device. It is therefore important that the claims be regarded as including such equivalent constructions insofar as they do not depart from the spirit and scope of the present invention.

Objects of the magnetic flower attachment device, along with various novel features that characterize the invention are particularly pointed out in the claims forming a part of this disclosure. For better understanding of the magnetic flower attachment device, its operating advantages and specific objects attained by its uses, refer to the accompanying drawings and description.

DETAILED DESCRIPTION OF THE DRAWINGS

With reference now to the drawings, and in particular FIGS. 1 through 5 thereof, example of the magnetic flower attachment device employing the principles and concepts of the present invention and generally designated by the reference number 10 will be described.

Figure 1:
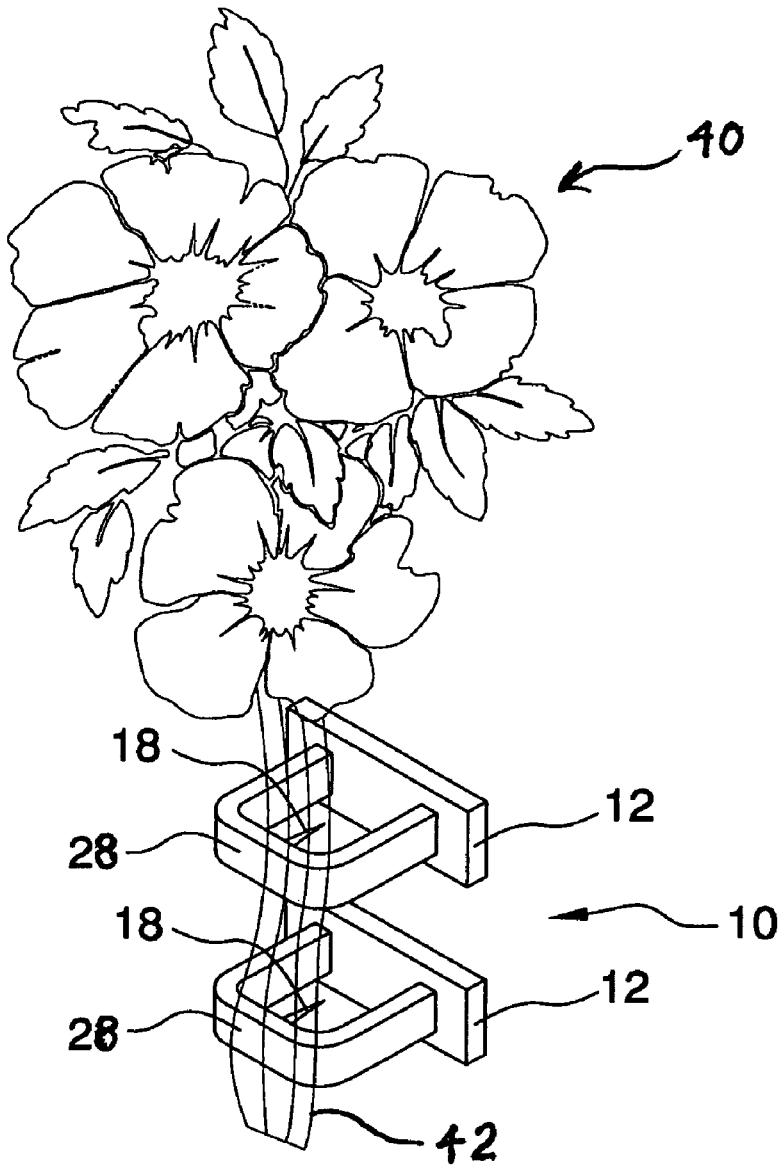
FIG. 1 is a perspective view of a pair of the inventions holding flower stalks within.
Figure 2:
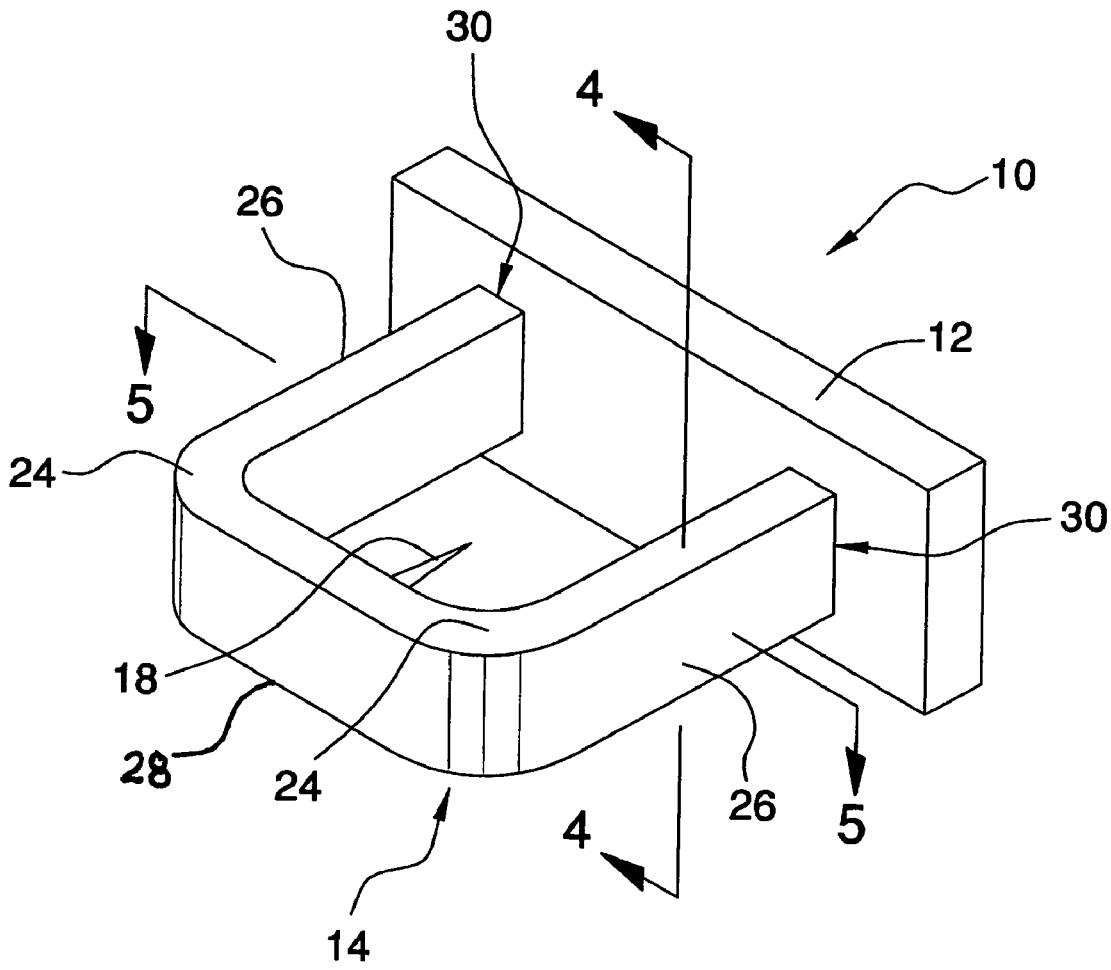
FIG. 2 is a perspective view illustrating use of the parent holder.
Figure 3:
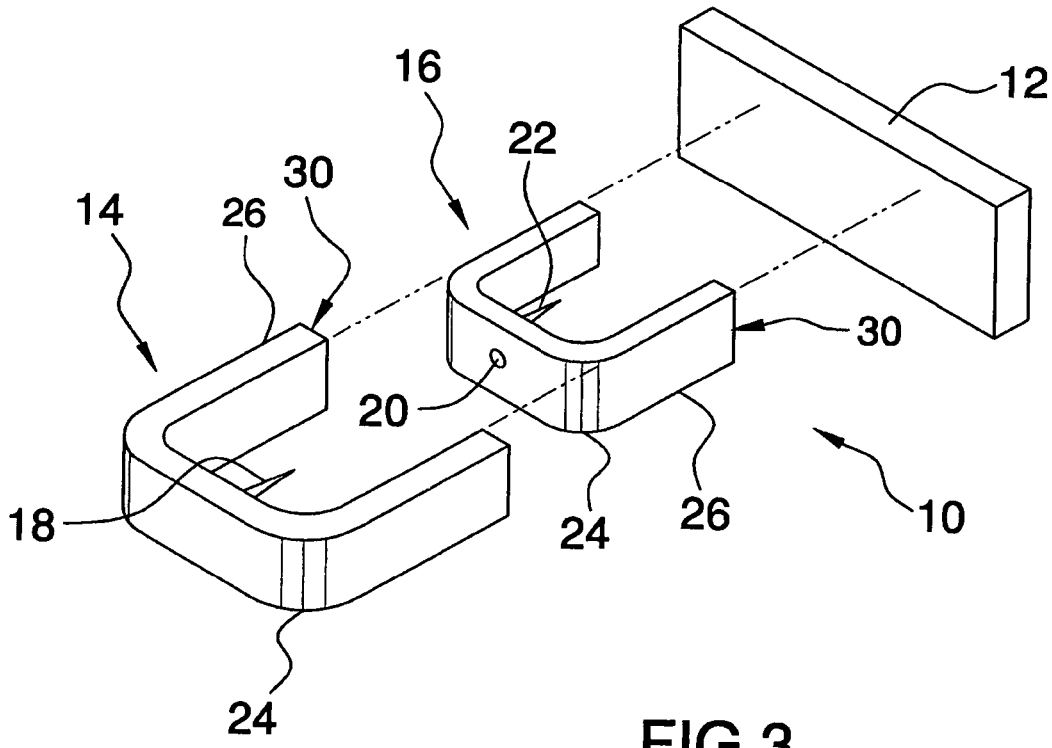
FIG. 3 is a perspective view with the parent holder and insert holder detached from the magnetic base.
Figure 4:
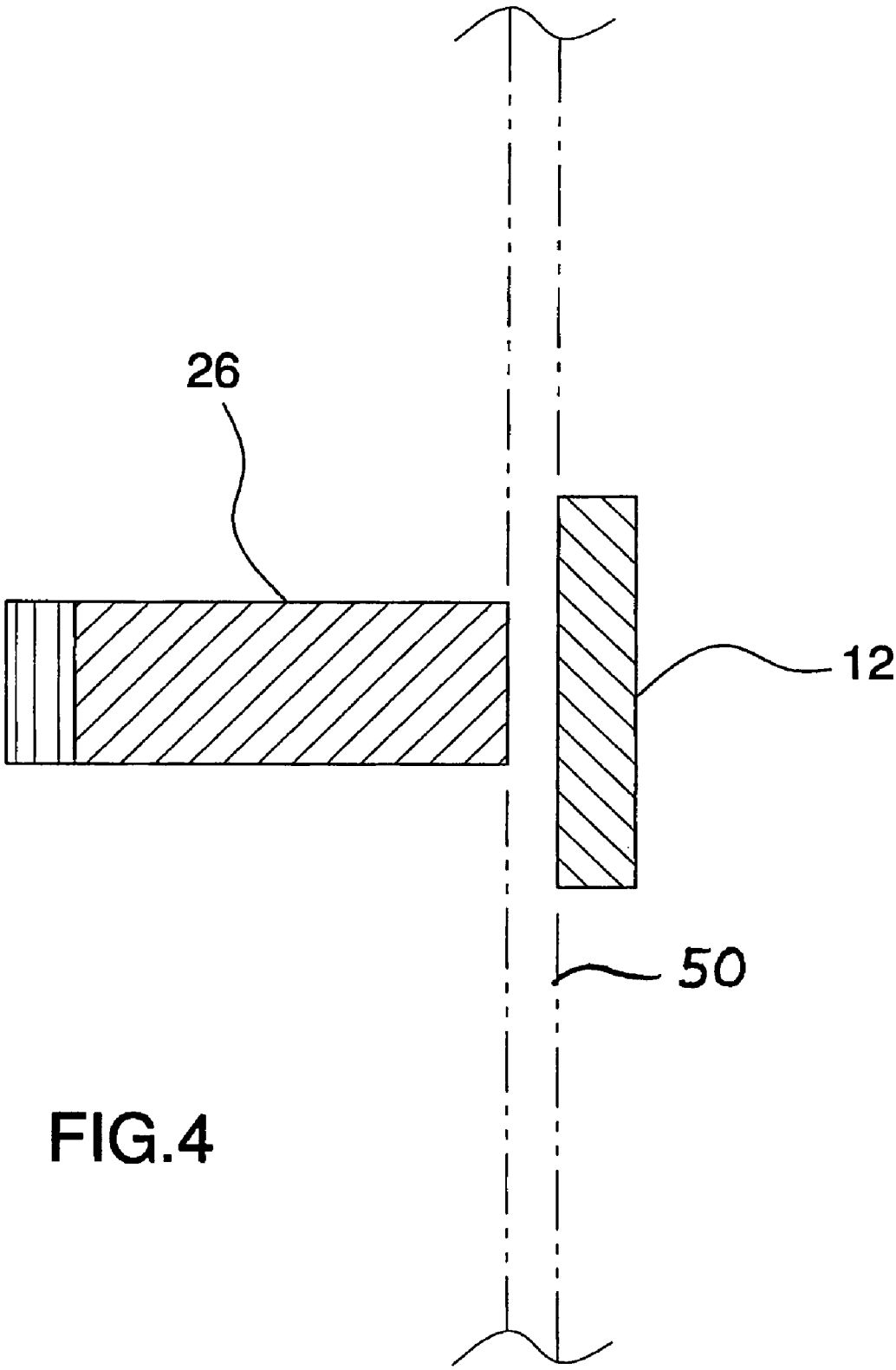
FIG. 4 is a cross sectional view of FIG. 2, with clothing trapped between the two parts of the invention—the legs and the magnetic base—taken along the line 4-4.

Referring to FIGS. 1 and 2, the invention 10 comprises a device for holding the flower stems 42 of flowers 40. Other ornaments, not pictured, may also be held to clothing. The invention 10 comprises a magnetic base 12 selectively positionable inside clothing 50 (FIG. 4). A typical example would be a dress or blouse or even gentleman's jacket breast. The base 12 may be positioned as desired. The u-shaped parent holder 14 has a first end of two spaced apart legs 26, each with an engagement face 30 (FIG. 3). The transverse 28 is disposed on a second end of the parent holder 14. The transverse 28 is on the ends of the legs 26 opposite the engagement faces 30. The u-shaped parent holder 14 contains a holder spike 18 centrally disposed within the transverse 28 and facing toward the magnetic base 12. The holder spike 18 is of an abbreviated relative length to the legs 26 such that clothing 50 (FIG. 4) is not harmed or pierced. The holder spike is preferably about one-third (⅓) to one-half (½) the length of the inside leg length. The parent holder 14 is positionable outside the clothing 50. The parent holder 14 is attracted to the magnetic base 12. Ornaments or flowers 40 are held between the legs 26 of the parent holder 14 and between the holder spike 18 and clothing 50. The parent holder 14 thereby removably secures the ornament or flowers 40 or the like to the clothing 50 without damage. The magnetic base 12 is preferably a parallelepiped shape and may be placed as desired, at any angle or position within clothing 50. The parent holder 14 is attracted to the magnetic base 12. Each leg 26 meets the perpendicular transverse 28 at a right angle bend 24, thereby joining the legs 26 together in the spaced apart arrangement. FIG. 1 illustrates the optional use of two inventions 10 in holding a larger flower 40. One invention 10 is disposed above the other invention 10.

Referring to FIG. 3, the invention 10 also includes an insert holder 16, used as desired and needed, with insert spike 22. The insert holder is positionable outside the clothing, as with the parent holder 14 holder spike 18. The engagement faces 30 and general shape of the insert holder 16 is identical to the parent holder 14 and functions identically. The insert spike 22 is permanently affixed within the transverse 28 of the insert holder 16. The spike 18 of the parent holder 14 is permanently affixed within the transverse 28 of the parent holder 14. The insert holder 16 is of a like shape to the parent holder 14 only smaller. The insert holder 16 removably fits within the parent holder 14. A smaller ornament can be held within the insert holder 16. Each of the insert holder 16 and the parent holder 14 u-shape is comprised of a transverse 28 with a rounded right angle bend 24 leading into two spaced apart parallel legs 26. The first end of each leg 26 further comprises an engagement face 30. The flat engagement faces 30 are perpendicular to the length of the legs 26 and are attracted to the magnetic base 12. The transverse 28 is on a second end of the insert holder 16. The insert holder 16 further comprises an orifice 20 in the center of the outside of the insert holder 16 transverse 28. The orifice 20 is for removable receipt of the holder spike 18 of the parent holder 14. The leg 26 lengths of the parent holder 14 and insert holder 16 are thereby preferably sized whereby the parent holder 14 holder spike 18 fits into the orifice 20 of the insert holder 16. The parent holder 14 and the insert holder 16 are selectively used in combination or separately to secure large or smaller ornaments to clothing 50. The magnetic and metallic properties of the base 12 and the holders 14 and 16 may be reversed. The legs 26 of the insert holder 16 are of a length that allows a space between the parent holder 14 transverse 28 and the insert holder 16 transverse 28 such that when the parent holder 14 and the insert holder 16 are magnetically engaged with clothing 50 between, there is sufficient space between the two transverses 28 to allow additional ornament containment. An example of use is placement of separate flowers 40 held by the parent holder 14 and the insert holder 16. Greater diversity in ornamental attachment is thereby provided by the invention 10, allowing for creativity in arrangement and various ornamental choices. The spikes 18 and 22 each provide for positive engagement of ornaments, thereby not requiring each size fit of a chosen ornament within either the parent holder 14 and the magnetic base 12 or the insert holder 16 and magnetic base 12, or between the insert holder 16 and parent holder 14.

Referring to FIG. 4, the magnetic attraction between the leg 26 and the magnetic base 12 provides for opposed holding of the two against the clothing 50. Obviously the use of the invention 10 is not limited to clothing. The invention may be place at any angle chosen with regard to clothing 50, limited only by imagination.

Figure 5:
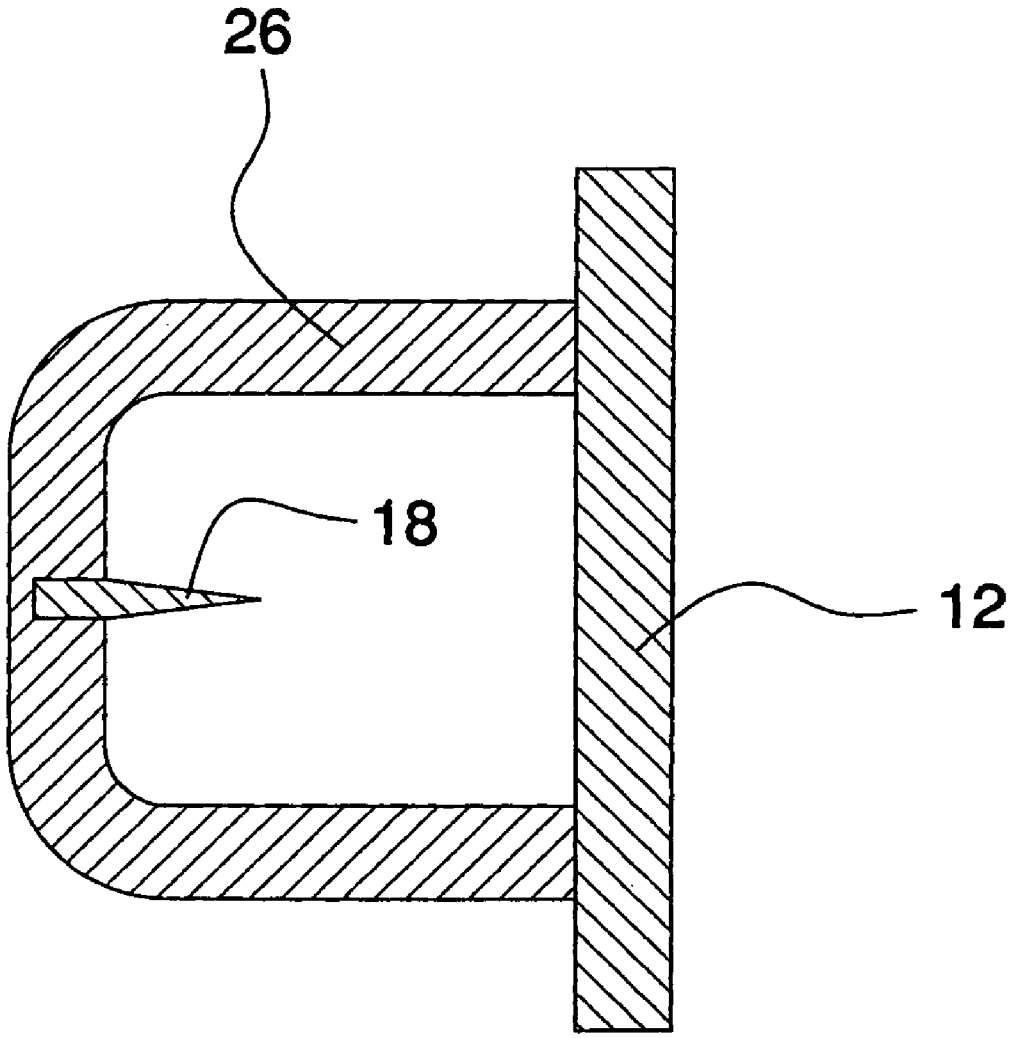
FIG. 5 is a cross sectional view of FIG. 2, taken along the line 5-5.

Referring to FIG. 5, the top cross sectional view illustrates contact of the engagement faces 30 of each leg 26 with the magnetic base 12. The spike 18 is parallel to the leg lengths 26 and perpendicularly faces the base 12. The spike 18 pictured is that of the parent holder 14. The spike 18 of the parent holder is permanently affixed within the transverse 28. The spike 18 is of sufficient length to retain a chosen ornament without endangerment to clothing or such.

With respect to the above description then, it is to be realized that the optimum dimensional relationships for the parts of the magnetic flower attachment device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device for removably holding flowers and other ornaments to clothing, the device comprising:

a magnetic base, the base for removable positioning on an inside of the clothing;

a u-shaped parent holder, the parent holder comprised of a pair of spaced apart legs connected by a transverse;

each leg comprising a length with an engagement face on a first end of the length of each leg;

the transverse disposed on a second end of the length of each leg, the transverse perpendicular to and connecting the legs;

a holder spike centrally and permanently positioned on an inside of the transverse, the holder spike parallel to the length of the legs, the holder spike facing the engagement ends of the legs, whereby the legs are removably positioned on an outside of the clothing by magnetic attraction of the engagement ends of the legs to the base, a flower or ornament thereby held between the legs;

wherein the perpendicular connection of the transverse to the legs is comprised of a rounded right angle bend;

wherein the holder spike is about one third to one half the length of an inside length of the legs;

a u-shaped insert holder, the insert holder selectively and removably inserted into the parent holder, the insert holder comprised of a pair of spaced apart legs connected by a transverse;

each insert holder leg comprising a length with an engagement face on a first end of the length of each leg;

the insert holder transverse disposed on a second end of the length of each leg, the transverse perpendicular to and connecting the legs, whereby the insert holder legs are removably positioned on an outside of the clothing by magnetic attraction of the engagement ends of the legs to the base, the flower or ornament thereby held between the legs.

2. A device for removably holding flowers and other ornaments to clothing, the device comprising:

a magnetic base, the base for removable positioning on an inside of the clothing;

a u-shaped parent holder, the parent holder comprised of a pair of spaced apart legs connected by a transverse;

each parent holder leg comprising a length with an engagement face on a first end of the length of each leg;

the parent holder transverse disposed on a second end of the length of each leg, the transverse perpendicular to and connecting the legs;

a holder spike centrally and permanently positioned on an inside of the parent holder transverse, the holder spike parallel to the length of the legs, the holder spike facing the engagement ends of the legs, whereby the legs of the parent holder are removably positioned on an outside of the clothing by magnetic attraction of the engagement ends of the parent holder legs to the base;

a unshaped insert holder, the insert holder selectively and removably inserted into the parent holder, the insert holder comprised of a pair of spaced apart legs connected by a transverse;

each insert holder leg comprising a length with an engagement face on a first end of the length of each leg;

the insert holder transverse disposed on a second end of the length of each leg of the insert holder, the transverse perpendicular to and connecting the legs;

an orifice within an outside of the transverse of the insert holder, the orifice centrally disposed, the orifice for the removable receipt of the holder spike of the parent holder, whereby the legs of the insert holder are removably positioned on an outside of the clothing by magnetic attraction of the engagement ends of the insert holder legs to the base, a flower or ornament thereby held between the legs of the insert holder, a flower or ornament thereby held between the parent holder and the insert holder.

3. The device in claim 2 wherein the perpendicular connection of the transverse to the legs of the insert holder is comprised of a rounded right angle bend.

4. The device in claim 3 wherein the holder spike is about one third to one half the length of an inside length of the legs of the parent holder.

5. The device in claim 4 wherein the perpendicular connection of the transverse to the legs of the parent holder is comprised of a rounded right angle bend.

6. The device in claim 3 wherein the perpendicular connection of the transverse to the legs of the parent holder is comprised of a rounded right angle bend.

7. The device in claim 2 wherein the holder spike is about one third to one half the length of an inside length of the legs of the parent holder.

8. The device in claim 7 wherein the perpendicular connection of the transverse to the legs of the parent holder is comprised of a rounded right angle bend.

9. The device in claim 2 wherein the perpendicular connection of the transverse to the legs of the parent holder is comprised of a rounded right angle bend.

10. A device for removably holding flowers and other ornaments to clothing, the device comprising:

a magnetic base, the base for removable positioning on an inside of the clothing;

a u-shaped parent holder, the parent holder comprised of a pair of spaced apart legs connected by a transverse;

each parent holder leg comprising a length with an engagement face on a first end of the length of each leg;

the parent holder transverse disposed on a second end of the length of each leg, the parent holder transverse perpendicular to and connecting the parent holder legs;

a holder spike centrally and permanently positioned on an inside of the transverse of the parent holder, the holder spike parallel to the length of the legs, the holder spike facing the engagement ends of the legs, whereby the legs of the parent holder are removably positioned on an outside of the clothing by magnetic attraction of the engagement ends of the legs to the base;

a u-shaped insert holder, the insert holder selectively and removably inserted into the parent holder, the insert holder comprised of a pair of spaced apart legs connected by a transverse;

each insert holder leg comprising a length with an engagement face on a first end of the length of each leg;

the insert holder transverse disposed on a second end of the length of each insert holder leg, the transverse perpendicular to and connecting the legs;

an insert spike on an interior surface of the insert holder, the insert spike parallel to the length of the insert holder legs;

an orifice within an outside of the transverse of the insert holder, the orifice centrally disposed, the orifice for the removable receipt of the holder spike of the parent holder, whereby the legs of the insert holder are removably positioned on an outside of the clothing by magnetic attraction of the engagement ends of the legs to the base, a flower or ornament thereby held between the insert holder legs, transverse, and the clothing, a flower or ornament thereby held between the parent holder and the insert holder.

11. The device in claim 10 wherein the perpendicular connection of the transverse to the legs of the parent holder is comprised of a rounded right angle bend.

12. The device in claim 11 wherein perpendicular connection of the transverse to the legs of the insert holder is comprised of a rounded right angle bend.

13. The device in claim 10 wherein the perpendicular connection of the transverse to the legs of the insert holder is comprised of a rounded right angle bend.

* * * * *